US006460746B1

(12) United States Patent
Amram

(10) Patent No.: US 6,460,746 B1
(45) Date of Patent: Oct. 8, 2002

(54) BACKPACK HAVING REMOVABLE, RE-POSITIONABLE CARRYING STRAPS

(76) Inventor: Fred M. B. Amram, 716 Third Ave. SE., Minneapolis, MN (US) 55414

( * ) Notice: Subject to any disclaimer, the term of this patent is extended or adjusted under 35 U.S.C. 154(b) by 0 days.

(21) Appl. No.: 09/295,700

(22) Filed: Apr. 21, 1999

(51) Int. Cl.[7] ..... A45C 15/00

(52) U.S. Cl. ..... 224/579; 224/580; 224/627; 224/628

(58) Field of Search ..... 224/153, 578, 224/579, 580, 581, 582, 583, 627, 628, 637

(56) References Cited

U.S. PATENT DOCUMENTS

| | | | | | |
|---|---|---|---|---|---|
| 946,856 | A | | 1/1910 | Harriman | |
| 995,963 | A | | 6/1911 | Harriman | |
| 1,696,191 | A | | 12/1928 | Coulson | |
| 2,224,568 | A | | 12/1940 | Altorfer | |
| 2,422,218 | A | | 6/1947 | Bauer | |
| 4,491,258 | A | | 1/1985 | Jones | |
| 4,660,751 | A | | 4/1987 | von Dewitz | |
| 4,810,102 | A | | 3/1989 | Norton | |
| 4,969,663 | A | * | 11/1990 | Nowacki | 280/808 |
| 4,979,658 | A | * | 12/1990 | Baker | 224/153 |
| 5,114,059 | A | | 5/1992 | Thatcher | |
| 5,181,638 | A | * | 1/1993 | McHale | 224/215 |
| 5,209,384 | A | | 5/1993 | Anderson | |
| 5,431,319 | A | * | 7/1995 | Cavadini et al. | 224/258 |
| 5,544,792 | A | | 8/1996 | Arnwine | |
| 5,577,652 | A | | 11/1996 | Cooper | |
| 5,615,812 | A | * | 4/1997 | Martin | 224/153 |
| 5,660,312 | A | * | 8/1997 | Suzuki | 224/627 |
| 5,799,851 | A | * | 9/1998 | Wulf et al. | 224/583 |
| 5,927,581 | A | * | 7/1999 | Reddy et al. | 224/578 |
| 5,934,527 | A | * | 8/1999 | Von Neumann | 224/153 |
| 5,950,894 | A | * | 9/1999 | Haber | 224/627 |
| 5,988,474 | A | * | 11/1999 | Smith, II et al. | 224/578 |
| 5,988,475 | A | * | 11/1999 | Han | 224/608 |
| 6,138,881 | A | * | 10/2000 | Paul et al. | 224/153 |

FOREIGN PATENT DOCUMENTS

| | | | | |
|---|---|---|---|---|
| FR | 2441358 | * | 7/1980 | 224/153 |

OTHER PUBLICATIONS

Joan MacFarlane "More children suffering from back pain, study says," Feb. 20, 1999, Cable News Network, at http://www.cnn.com/Health/9902/20/teen.back.pain/index/html, as captured Feb. 23, 1999.

Associated Press, "Bookbag woes—Many children carry around too much weight," Nov. 9, 1998, Cable News Network at http://www.cnn.com/Health/9811/09/bookbag.burdens.ap/index/html, as captured Feb. 24, 1999.

"Spinal damage in children linked to school bags," The Byron Shire Echo, Jan. 27, 1998, http://www.echo.net.au/echo/archives/echo_12.34/bags.html, as captured Dec. 25, 1998.

(List continued on next page.)

*Primary Examiner*—Stephen K. Cronin
(74) *Attorney, Agent, or Firm*—Larry M. Jennings, P.A.

(57) ABSTRACT

A backpack that has straps which may be repositioned, removed and replaced is designed to reduce muscle strain when the bag is carried by improving the balance of the load. Re-positioning the straps can enable a person to re-position the load closer to the center of the body to reduce the leverage exerted by an unbalanced load. An additional feature is that removable straps can be interchanged or replaced inexpensively with other straps that have different colors, trademarks, advertisements, or other indicia of support or affiliation. An advantage of the methods and apparatus shown is that the cost of replacing straps is inexpensive compared to the cost of replacing a backpack. The lower cost may make it possible for a business to furnish straps bearing its indicia as promotional items at a cost that is comparable to the cost of baseball-type hats, calendars, and similar items.

11 Claims, 9 Drawing Sheets

OTHER PUBLICATIONS

Art Carey, "A heavy load to bear– Kids' backpacks may lead to serious back problems," Idaho Post Register, Dec. 11, 1997, http://www.idahonews.com/121197/Health_A/10820.HTM, as captured Dec. 25, 1998.

"Don't Let Your Pack Hurt Your Back," Bayfront Medical Center's Health Adventure, Sep. 8, 1997, http://www.bayfront.org:8080/explore/kids_news/970908kenews.html#dont, as captured Dec. 25, 1998.

"Bad Backs Bad for Back to School," PR Newswire, Aug. 29, 1997, http://www.kidsource.com/kidsource/content3/news/bad.backs.k12.2.html, as captured Dec. 25, 1998.

Nicole Bondi, "Backpacks shouldn't be a pain to carry," The Detroit News, Aug. 25, 1997, http://www.detnews.com/1997/metlife/9708/25/08250061.htm, as captured Dec. 25, 1998.

Bob Condor, "If you tote that load wrong, your body will revolt," Seattle Times, Jul. 9, 1997, htt://www.seattletimes.com/extra/browse/html97/pack_070997.html, as captured Dec. 25, 1998.

Johns Hopkins University, "Backpack Alert– When in Doubt, Leave it Out," Aug. 29, 1996, http:hpokins.med.jhu.edu/NewsMedia/press/1996/Aug./19966.htm, as captured Dec. 25, 1998.

Felicia D. Henderson, "Backpack can be pain in the neck," The Detroit News, Sep. 22, 1995, http://detnews.com/menu/stories/17330.htm, as captured Dec. 25, 1998.

* cited by examiner

BACKPACK HAVING REMOVABLE, RE-POSITIONABLE CARRYING STRAPS

TECHNICAL FIELD

The present invention relates to the field of containers for carrying objects, generally, and specifically to closable bags, or sacks, that people may use to carry a multiplicity of objects. More specifically, articles according to the present disclosure are related to the field of backpacks of the type used for carrying clothing, books, tools, food, and personal items. A preferred embodiment of the present disclosure is related more particularly to the field of convertible backpacks that can be carried comfortably on both of, or either one of, a person's shoulders and which have one or more removeable, re-positionable straps that may be readily configured to accommodate the changing needs and preferences of each person who uses the backpack. For the purposes of the present disclosure, backpack, bookbag, knapsack, haversack, and rucksack, are deemed synonymous unless the context clearly distinguishes the meaning of one or more of those terms.

BACKGROUND

The popularity of backpacks has surged in recent years. With increased backpack use, there has been a corresponding increase in reports of injuries, especially among students, that result from carrying backpacks that are too heavy, from failing to maintain correct posture, and from carrying unbalanced loads. An estimated 3,300 children aged 5 to 14 were treated in emergency rooms in 1997 for injuries related to bookbags. Another study recently found that 6 percent of 10-year-olds complained of back pain, while 10 to 15 percent of 12-year-olds reportedly had back pain. Doctors believe one reason for the rising incidence of back pain among youth may be the modern-day bookbag—the backpack.

It is generally recommended that a loaded backpack should not exceed 10% of the weight of a child, and that the backpack should be carried on both shoulders. Health care professionals have consistently advised students and youths to carry backpacks over both shoulders. Despite these admonitions, many fashion-conscious students prefer to carry their packs by one strap over one shoulder, and if they do, they should alternate shoulders.

Backpacks of the type used by students are not merely utilitarian containers for objects that the wearer may need during the course of a day. They are also accessory articles of apparel that may be selected on the bases of color, pattern, style, brand name, or coordination with other articles of apparel. In addition to the utility and appearance of a backpack, the style and manner with which it is worn or carried is presently important to many students.

The risk of improper lifting and carrying is widely recognized in workplace settings. In the U.S. however, schools and other institutions with a constituency of children have not recognized any duty to reduce the exposure of their constituents to the risks of skeletal damage by discouraging their constituents from carrying backpacks that are too heavy. Other countries have observed the problem of students carrying backpacks that are too heavy. In 1996, the Bangkok, Thailand education ministry, concerned about the risk of spinal damage, set a backpack weight limit of six pounds for primary school students. Prior to banning heavier backpacks, the Bangkok education ministry had found that the weight of more than half the primary students' backpacks exceeded six pounds.

Numerous examples of backpacks and similar gear have been designed with the purpose of reducing the strain to which the person using the gear is exposed. Development of backpacks generally has focused on enabling individuals to more easily carry items to which they wish to have ready access. Some pack apparatus are designed to hold the load closer to the body of the person carrying the pack. Maintaining the load close to a person's body reduces the effort required to keep balance and reduces the leverage by which the burden can act against the person's muscles.

Other designs seek to reduce the strain on the user by making it convenient to vary the way the pack is carried so that the exertion required to carry the load can be shifted among different muscle groups and, as a consequence, the other muscle groups can periodically rest and recover from exertion. Several inventors have developed bags that may be carried either on the back or under an arm by shoulder straps or else by grippable handles.

For example, U.S. Pat. No. 5,577,652 issued Nov. 26, 1996 to Cooper for a Convertible Backpack. Cooper's patent is directed to a backpack that is convertible from one carrying method to another. The Cooper backpack can be carried with two shoulders, one shoulder, or with the strap crossing the wearer's chest diagonally. The article differs from a conventional backpack in that a single strap is provided. Each end of the strap is fitted with a clasp that can engage the usual lower strap D-rings. Conventional backpacks normally have the upper end of each strap fixedly sewn to the center upper portion of the backpack. Cooper's backpack is fitted with a ring, sleeve, slot, or loop through which the central part of the strap may slide. With equal parts of the strap on either side of the strap ring, the strap can fit onto both shoulders. The article may be converted to a shoulder bag, or tote, by sliding the strap to one side or the other and carrying the bag on only one shoulder. Cooper illustrates no provision for securing the carrying strap at any specific position. Neither this '652 patent nor the Norton U.S. Pat. No. 4,810,102 has been designed to ameliorate the health risk issues that initiated development of embodiments according to the present disclosure.

U.S. Pat. No. 5,544,792 issued Aug. 13, 1996, to Arnwine for a Convertible Student Book Bag. Arnwine discloses a modular student book bag that is fitted at one location on the bag structure with a strap for carrying the bag with one shoulder and, at another location on the structure, a pair of straps for carrying the article with two shoulders. The straps appear to be neither re-locatable nor removable.

U.S. Pat. No. 5,209,384 issued May 11, 1993 to Anderson for a Portable Tool Kit. Anderson's portable tool kit shows a bag that may be carried by a pair of shoulder straps. A pair of additional handles may be drawn to show carrying the kit with one hand or one shoulder.

U.S. Pat. No. 5,114,059 issued May 19, 1992 to Thatcher for a Universally Adjustable Frameless Backpack. The patent for Thatcher's universally adjustable frameless backpack discloses a pack designed to meet different needs than those for which the present invention is intended. It does, however, show some construction techniques that may be adaptable for use in various models of the present invention.

U.S. Pat. No. 4,810,102 issued Mar. 7, 1989 to Norton for a Universal Sport Bag. Norton describes a sport bag that, although it is not explicitly designed as a backpack, does accommodate being carried on one shoulder, on two shoulders, or on a belt that encircles a person's waist. Norton does not, however, disclose any enhancement that improves the ability of an individual to carry a backpack on one shoulder.

U.S. Pat. No. 4,660,751 issued Apr. 28, 1987 to von Dewitz for a Device to Secure Shoulder Straps of a Rucksack. Von Dewitz discloses a securement for the upper ends of shoulder straps for a backpack (or rucksack). The angles at which the straps attach to the pack can be varied to accommodate the build of the person who carries the pack.

U.S. Pat. No. 4,491,258 issued Jan. 1, 1985 to Jones for a Convertible Backpack. Jones discloses a good example of a backpack that may be converted into one or more other useful objects. The Jones disclosure was directed primarily toward mounting bags and panniers on bicycles that, when removed from a vehicle, could be configured so that a person could carry the bags as a backpack.

U.S. Pat. No. 2,422,218 issued Jun. 17, 1947 to Bauer for a Golf Club Bag. Bauer describes a golf club bag that has both hand and shoulder straps. The single shoulder strap is configured to enable the user to carry the bag with only one strap but also have the load be properly balanced. In fact Bauer states that his golf club bag provides "an improved form of a strap for shoulder carriage of the bag [the strap being] adapted to girdle the shoulder and arm pit for sustaining the bag in perpendicular slanting position for a self-balancing carriage." Bauer states that his carrier arrangement will "avoid instituting a forearm downward pressure upon the bag and clubs" to provide adequate balance and clearance. Bauer does not, however, disclose an apparatus that is compatible with the structure of a soft backpack or that is compatible with all of the various utilitarian and stylistic purposes to which backpacks are presently applied.

U.S. Pat. No. 2,224,568 issued Dec. 10, 1940 to Altorfer for a Ski Bag. Altorfer discloses a ski bag and ski attachment bracket that includes a sling, or harness, assembly that may be worn over one shoulder, both shoulders, or across the chest, depending on the preferences and the activities of the wearer.

U.S. Pat. No. 1,696,191 issued Dec. 25, 1928 to Coulson for a Pack. Coulson discloses a type of pack sling that is adjustable so that a suitcase can be carried on the shoulders and back of an individual traveler. The suitcase was asserted to be superior to soft packs for carrying articles.

U.S. Pat. No. 995,963 issued Jun. 20, 1911 to Harriman for a Pack Sling. Harriman discloses a pack sling that has adjustable shoulder straps and which is readily adapted to carrying a variety of other items.

U.S. Pat. No. 946,856 issued Jan. 10, 1910 to Harriman for a Combined Roll Carrier and Haversack. Harriman discloses a combined roll carrier and haversack that includes adjustable shoulder straps.

Despite the efforts of the workers mentioned previously and the efforts of many other inventors, artisans, and designers, there has not been a satisfactory product that is useful either for load-carrying purposes, generally, or for the purpose of meeting the needs of persons who use backpacks. Although numerous periodicals have published articles urging backpack users to carry their packs on both shoulders, many students routinely carry their backpacks slung over one shoulder. There may be several reasons that people choose to do so. Some people find it difficult or annoying to don and doff a backpack on both shoulders, especially if heavy coats are also being worn. It is likely that some people find that they can more quickly move from place to place and between classrooms if they do not take the time to put a backpack on both shoulders. Some people may find it more fashionable to carry a backpack by a single strap.

A backpack is a fashion accouterment that may be selected and worn for the purpose of satisfying many needs in beyond functioning to replace briefcases and bookbags. The way in which the backpack is worn (e.g. high, between the shoulder blades; low, at the small of the back, etc.) can serve as an identifiable link to a particular group. Members of particular groups may anticipate that others with similar taste in backpack fashion will share a cluster of beliefs, attitudes, and desires.

Other groups, such as the students enrolled at a particular college or university, may desire to have backpacks that exhibit a logo or other indicia of the particular group or institution with which they are affiliated. Other individuals may desire to show their support of a cause, an athletic team, a municipality, or other entity with which they wish to be identified. A backpack is particularly suited to this purpose because, when it is in use, it is nearly always exposed to the view of others, people tend to own few backpacks (i.e. many people own only one, replacing it when necessary) and backpacks are generally in public use almost daily.

Traditional backpacks have not fully satisfied the commercial potential of the product for a variety of reasons. One reason may be the economic difficulty of making many short production runs to meet the unique specifications of each of the many different schools, colleges, sororities, universities, teams, choirs, fraternal organizations, clubs, employers, and other affinity groups that may wish to provide its members with a recognizable visible link to one another. In addition to exhibiting indicia of affinity, a backpack can be used to exhibit advertising messages, logos, emblems, graphic fashion designs, slogans, business names, personal names, color schemes, and color coordination according to the wearer's choice. If the color scheme is fixed (as it has traditionally been) when the backpack is presented to the prospective customer and offered for sale, an increasing number of options from which customers may select tends to increase product cost to offset the larger inventory, purchasing, and control costs of the manufacturer, the greater packaging, labeling, tracking and other costs of the distributor, and the increased inventory, stocking and training costs of the retailer. To further develop the market for this product, a method is needed by which the appearance of a backpack may be adapted to the specific preferences of various individuals and groups.

Since it appears unlikely that people will soon be persuaded to stop carrying backpacks by one strap, another way to reduce the likelihood of injury is to mitigate the deleterious effect that may be expected in some individuals by designing the backpack to accommodate the uses to which it will actually be put. In other words, none of the workers in the field have been able to create a backpack that is specifically adapted for being carried by one strap on one shoulder in addition to having the capability for being carried by two straps, one over each of a person's shoulders.

There presently exists an unmet need for a backpack that a person can carry on one shoulder and that is adapted to minimize load imbalance. Another need is for a backpack that can be readily adjusted to properly fit the user. A third need is for a backpack that is adapted for being carried in different manners—on one shoulder, on the other shoulder, on both shoulders, on one side, on the other side, higher, lower, etc.—to minimize the likelihood of muscle strain, other injury, and painful symptoms. Yet another unmet need exists in the art for a backpack adapted for carrying specific goods such as tools, clothing, materials, samples, or merchandise and which is readily adapted for being carried at the angles that, in terms of ergonomics, are the most appropriate carriage angles that can be obtained in practice whether the backpack is carried by a single strap, two straps, or with optional additional elements including, without limitation, waist bands, sternum straps, and/or shoulder harness.

A further unmet need in the field is for a backpack that can be readily adapted for the exhibition of various indicia and other graphic elements. Graphic elements can be displayed to great effect upon backpacks generally, but most particularly, from the straps. Various coordinating or contrasting colors and patterns may easily be incorporated into the ornamental appearance of the straps. Trademarks, certification marks, collective marks, and service marks can be applied under license from mark owners to provide enhanced appeal and sale of products including backpacks and backpack straps. Licensing of marks and designs has become an important source of revenue for many colleges and universities, for various supervisory organizations, and even for some commercial enterprises. Although commercial indicia, symbols of organizations, and other displays of affiliation or promotion by affixing the marks to articles such as backpacks, there has been little of such ornamentation applied. Use of backpacks to display affinity and commercial messages has been inhibited by the practical difficulty of producing at an economical price many customized versions of a relatively complicated product in order to meet the preferences of several unrelated niche markets.

SUMMARY OF THE INVENTION

What is needed, then, is a backpack that is easy to don and doff, that may be quickly and easily adjusted over an enhanced range of adjustment so that individuals of all sizes and body types can use an embodiment according to the present disclosure to mitigate the effects of carrying imbalanced loads including the load imbalances caused by carrying a backpack over one shoulder.

Further needs in the field include desirable appearance and ready adaptability to the needs of diverse individuals and groups each of which may have differing needs and purposes. Also sought in the field is a backpack with straps that may be quickly, easily, and economically removed from both the top and the bottom of the pack and replaced with straps that bear a different logo, a different color or a different color scheme.

All of the foregoing needs are sought in a backpack having straps that may be oriented diagonally or vertically, or otherwise, in order to achieve the most ergonomic configurations.

Considerable inventive skill has been applied by workers in the field of backpack design and fabrication to improve backpacks. Despite the sustained efforts of earlier inventors, advancements and refinements in backpack design continue in response to changing needs of those who use backpacks. The availability of new materials that may be incorporated into backpack construction, the evolving preferences of persons who use backpacks, changes in the composition of items that persons desire to carry in backpacks, and changes in fashion have contributed to activities and advances in advanced backpack styles. Those efforts have failed, until now, to produce a backpack having a range of adjustment sufficient to enable a backpack to be carried in relative comfort by one shoulder strap and to minimize the risk of muscle strain that might be caused by carrying unbalanced loads.

An embodiment according to the present disclosure is a backpack having removable, re-positionable carrying straps comprising a sack having a front portion, a back portion, a first side portion, a second side portion, a bottom, and a selectably closeable and openable top, a strap having a first end and a second end, a releasable fastener portion affixed proximate the first end of the strap, a releasable fastener portion affixed proximate the second end of the strap, a plurality of mating fastener portions affixed to the back of the sack and arranged with at least one mating fastener portion proximate the bottom of the sack and at least one mating fastener portion being affixed to the sack proximate the top, each of the mating fastener portions being adapted to selectably engage a releasable fastener portion.

The present invention is an improved backpack that may have two, or optionally, several, removable, re-positionable carrying straps. Both the upper and the lower ends of the carrying straps can be re-positioned laterally. Users may adjust strap lengths with conventional or subsequently developed means so that it fits a large range of body sizes and types. The adjustments also allow the pack to accommodate full pack loads, whether the weight is concentrated at the bottom, top, side, or distributed evenly.

The person using the new pack may carry it with one or both shoulders. It is an object of the invention to enable the pack to be better balanced than are conventional packs when it is being carried with one strap over one shoulder. Strap attachment and adjustment points can be established in a bilaterally symmetrical configuration so that an individual can shift the burden from one shoulder to the other regularly. It is desirable for a person to shift a load being carried from one shoulder to the other to reduce fatigue, stress, muscle strain, and joint wear. Although it accommodates being carried with one shoulder at a time, the new backpack is constructed so that it may, at any time, be carried on either shoulder or on both shoulders.

Functionality is enhanced because the wearer can balance the pack more evenly when carrying it on one shoulder; in addition, the pack straps are completely removable. A backpack user may find it more comfortable to remove the second strap when the pack is carried by a single strap. Removable pack straps make possible the option of providing a multiplicity of relatively inexpensive straps or strap pairs that may be attached interchangeably to the pack.

Straps adapted to a variety of purposes could be attached according to the user's needs or wishes. By way of example, and not as a limitation, it is possible to make straps that match the colors of a school that the owner of the pack attends; straps may be colored and styled to coordinate with other items and apparel. Allowing a backpack purchaser to select straps that have a variety of colors and designs should make it easier for the person to coordinate the pack with wearing apparel to obtain the desired "look."

The ability to replace backpack straps creates promotional and advertising possibilities that previously were simply unavailable. Straps may be emblazoned with advertising messages; straps may be given as premiums or promotional items at events; straps may be coated with reflective, luminescent, phosphorescent or safety materials; straps may coordinate with a particular marketing program or advertising participation campaign.

Specifically, the present disclosure teaches a method for displaying indicia comprising the steps of: making a backpack having removable, re-positionable carrying straps by, making a sack having a front portion, a back portion, a first side portion, a second side portion, a bottom, and a selectably closeable and openable top, affixing at least two first mating fastener portions proximate the bottom of the sack, each of the first mating fastener portions being adapted to selectably engage a first releasable fastener portion, affixing at least two second mating fastener portions proximate the top of the sack, each of the second mating fastener portions being adapted to selectably engage a second releasable fastener portion; making a plurality of carrying straps, each of which has a first end terminated by a first releasable fastener portion and a second end terminated by a second releasable fastener portion, applying indicia to the straps, and releasably attaching the straps to the backpack.

Backpack straps having various functional differences could be provided for different purposes. In order to reduce sway, for instance, straps that are stiffened to restrict lateral displacement may be provided to position the pack at a desired location or orientation for carrying. An example of material that could be incorporated into a backpack strap to prevent lateral displacement is any of a variety of linked belts or roller chains of the type commonly used on bicycles. Roller chains are available in duplex, triplex, and higher multiple configurations in addition to the familiar simplex bicycle chain. Functionally similar for the purposes of this disclosure are various linked belts which act as a series of hinges. Pivoting movement in one plane is nearly effortless while movement perpendicular to that plane is restricted. Some other materials have similar properties. For example, it may be possible to find or create a polymer, or blend of polymers that could be incorporated within backpack straps to obtain properties useful in holding the backpack in the most ergonomically favorable position that is practical for the wearer.

It may also be desirable to include semi-rigid stiffener members within, in addition to, or in place of straps. Such members may provide useful assistance in holding the pack at desired locations or orientations and they could be conformable to the body of each individual.

In order to maximize the functionality available to a person using the present invention, the new backpack may optionally be fitted with a handle for hand-carrying the pack. An alternative configuration may optionally include either an optional long strap or else means for interconnecting the two over-the- shoulder straps so that the embodiment may be carried as a shoulder bag.

The backpack described generally, above, and in detail, below, making specific reference to the various drawing figures, overcomes several of the limitations inherent in backpacks known in the art previously and minimizes the impact of other limitations.

Figure 1:
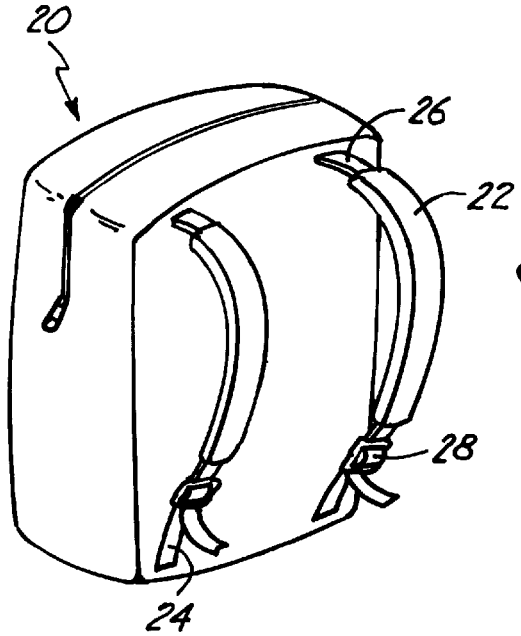
Fig. 1 PRIOR ART
FIG. 1 is a perspective view of a typical backpack in the prior art.

DETAILED DESCRIPTION OF THE DRAWINGS AND BEST MODE FOR CARRYING OUT THE INVENTION

The present invention as well as its objects and advantages can be illustrated by describing the fabrication, structural elements, characteristics and functional elements of the preferred embodiments as shown on the attached drawing sheets.

Referring to the drawings, and initially to FIGS. 1–3, a backpack having removable, re-positionable carrying straps and method for its fabrication will be described. Alternative embodiments are presented in FIGS. 4–9.

Referring to FIG. 1, a conventional prior art backpack 20 is depicted. The prior art backpack 20 may be carried using the prior art straps 22 each of which is attached to the backpack 20 at a lower attachment point 24 and at an upper attachment point 26. Strap length may be adjusted by a length adjustment 28.

Figure 2:
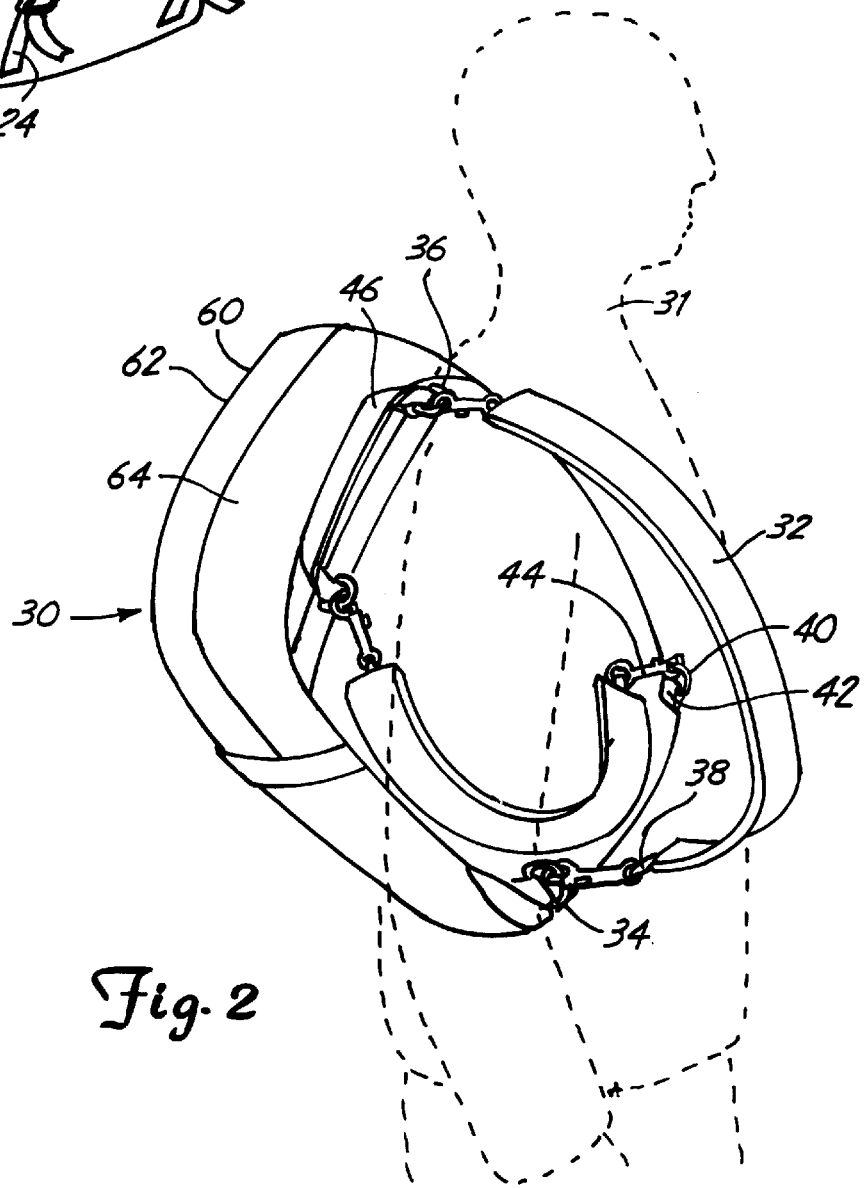
FIG. 2 is a perspective view of a backpack having removable, re-positionable carrying straps.

Referring now to FIG. 2, a backpack having removable, re-positionable carrying straps 30 is depicted being carried by a person 31 using a single removable, re-positionable carrying strap 32 that is linked to a lower strap attachment point 34. An upper detachable attachment portion 36 is provided for selectively connecting the strap 32.

Figure 3:
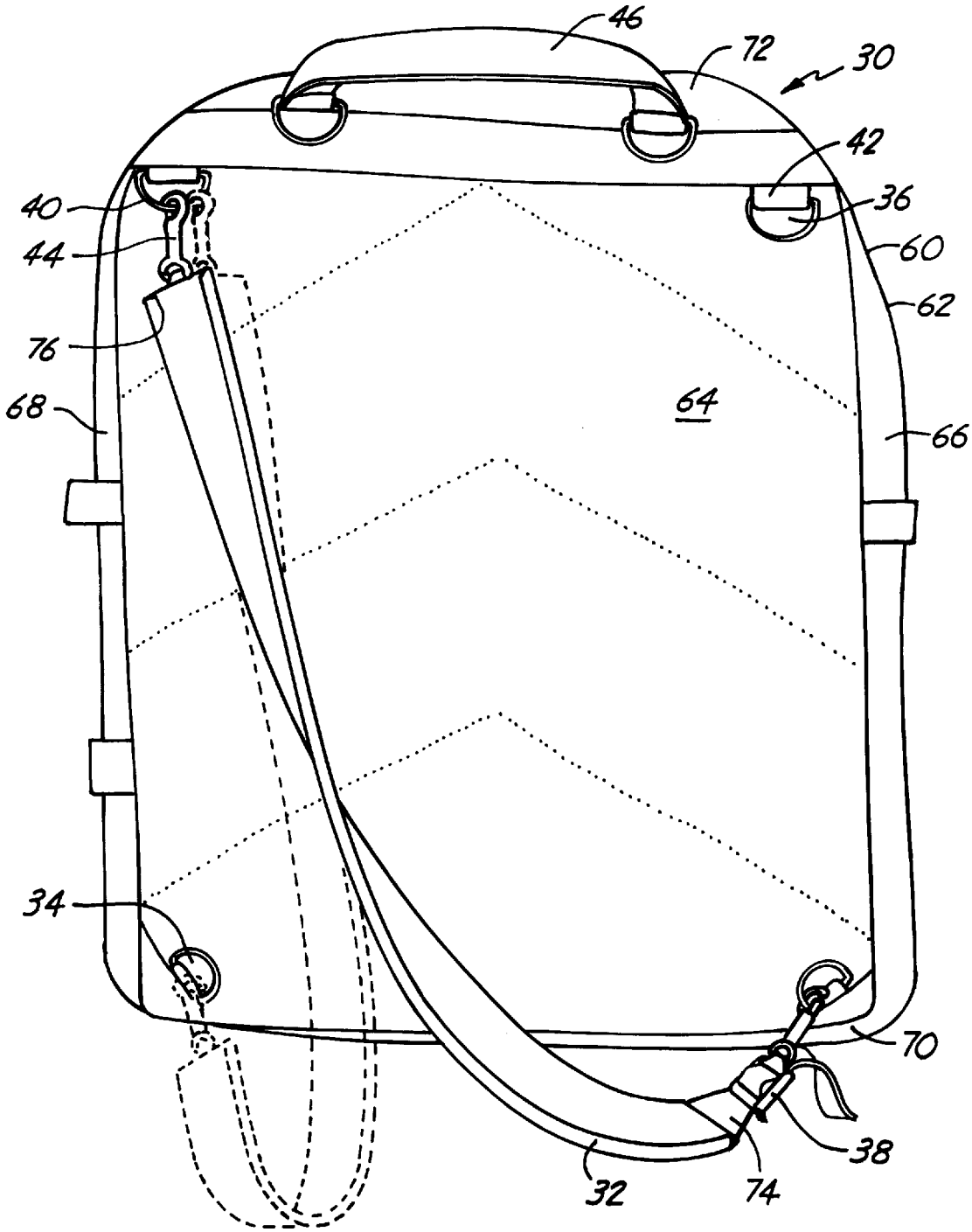
FIG. 3 is a back elevation view of the backpack having removable, re-positionable carrying straps shown in FIG. 2.

Referring now to FIG. 3, a strap length adjustment 38 may be provided for some or all of the straps 32.

The straps 32 may have any of several types of attachment devices. One simple and reliable method is to affix a mating fastener portion 40 to the backpack 30 with a loop of webbing 42. Although the mating fastener portion depicted in FIG. 3 is a "D" ring, many other types of hardware are commercially available that can serve as well, some of which are included in subsequent figures depicting alternative embodiments.

A releasable fastener portion 44 of any type that is selectively attachable and detachable with the mating fastener portion 40 may be adapted to, and installed upon the end of the strap 32. Although a slide snap rope hook is depicted, it is shown by illustration only and not for the purpose of limitation of the alternative embodiments disclosed herein.

The backpack is fitted with a handle 46 that can be used to carry the pack 30 at one's side by hand.

An embodiment according to the present disclosure is a backpack having removable, re-positionable carrying straps 30 comprising a sack 60 having a front portion 62, a back portion 64, a first side portion 66, a second side portion 68, a bottom 70, and a selectably closeable and openable top 72, a strap 32 having a first end 74 and a second end 76, a releasable fastener portion 44 affixed proximate the first end 74 of the strap 32, a releasable fastener portion 44 affixed proximate the second end 76 of the strap 32, a plurality of mating fastener portions 40 affixed to the back 64 of the sack 60 and arranged with at least one mating fastener portion 40 proximate the bottom 70 of the sack 60 and at least one mating fastener portion 40 being affixed to the sack 60 proximate the top 72, each of the mating fastener portions 40 being adapted to selectably engage a releasable fastener portion 44.

Figure 4:
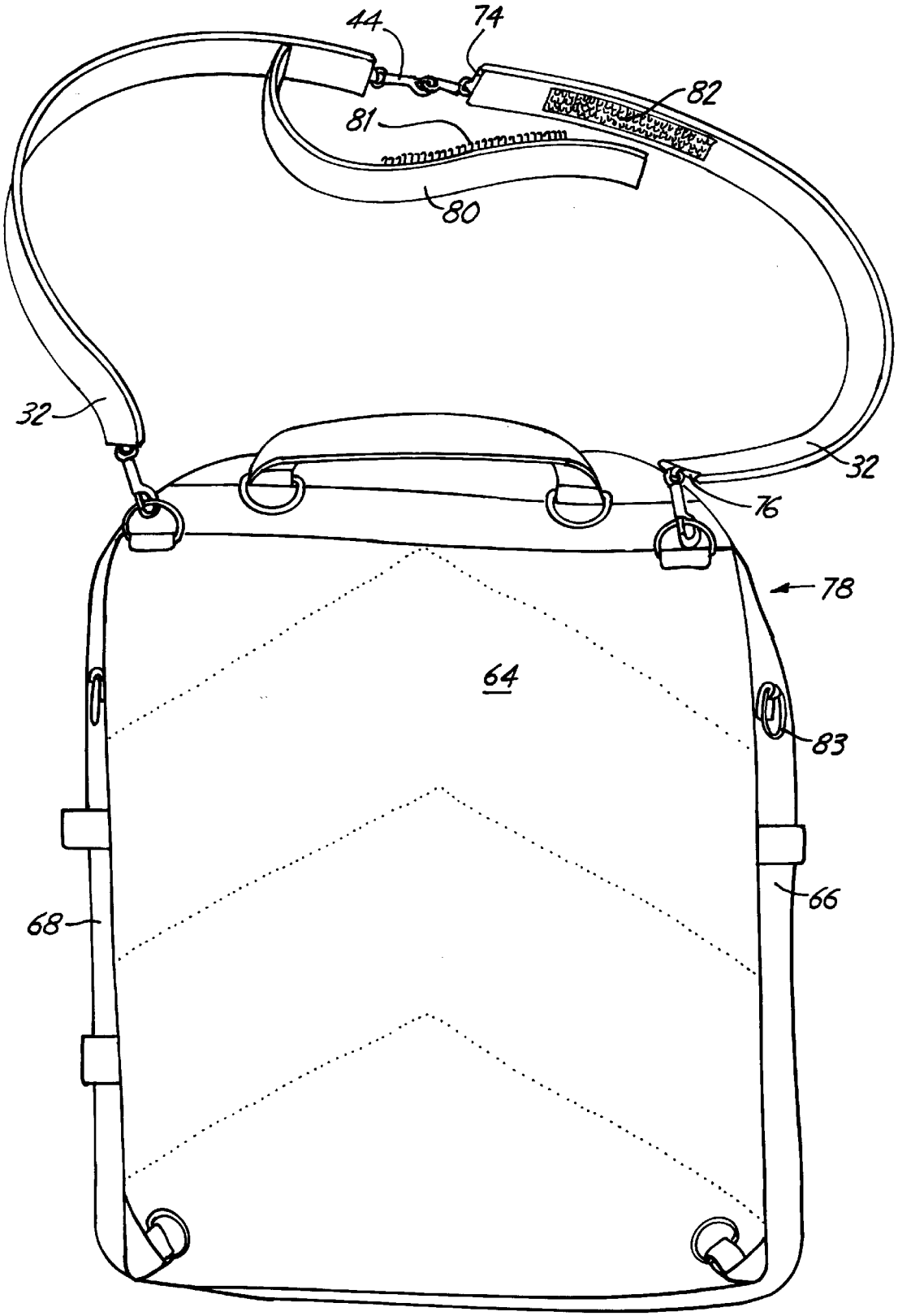
FIG. 4 is a back elevation view of an alternative embodiment of the backpack having removable re-positionable carrying straps of FIG. 2 wherein the straps are configured for a person to carry the pack as a shoulder bag.

FIG. 4 is a back elevation view of a first alternative embodiment 78 of the backpack 30 wherein the straps 32 are depicted in a configuration that allows a person to carry the pack 78 as a shoulder bag. In the depicted configuration, the first ends 74 of two straps 32 are attached lengthwise by the releasable fastener portions 44. An optional pad 80 is shown schematically to make carrying more convenient. In some configurations, the pad 80 may be removable or adjustable. In such cases, the straps 32 might be fitted through slits in the pad 80, or it might be held in place by a fastener such as a loop, adhesive, or, as depicted, by meshing the hook portion 81 with the loop portion 82 of a hook-and-loop fastener system.

Straps 32 may optionally be attached to the sides of the backpack 30. An optional first side mating portion 83 can be affixed to the first side panel 66 and a second side mating portion 84 can be attached to the second side panel 68 to yield better balance when the backpack 30 is being carried as a shoulder bag. A multiplicity of side mating portions 83, 84 spaced apart both horizontally and vertically may optionally be incorporated into the backpack 30 and any alternative embodiments to maximize configurability and ergonomic benefits.

It is to be understood, however, that a single long strap, either with or without length adjustment features, could be provided so that the person who uses the pack would not be required to connect the straps 32 together end-to-end. In embodiments having either end of the carrying straps 32 permanently, fixedly attached to the back 64 of the pack, as shown in FIG. 1, it would be preferred to include an optional single long strap that would permit the backpack 30 to conveniently be carried at a person's side. Although it is believed preferable to construct embodiments according to this disclosure with carrying straps that may be completely removed, it is not essential to do so. It may be learned that it is desirable to have the straps fixed to the backpack 30 at one end or the other.

It is further to be understood that any type of releasable fastener portion 44 together with any suitable mating fastener portion 40 may be used to carry out the invention. Known and commercially available types of fasteners that for the purposes of the present disclosure are equivalent to those depicted in the figures are far too numerous to mention. Belts, buckles, tapes, spring closure hooks, in-line slide fasteners, cam-action, and hook-and-loop fasteners are depicted in various figures of the drawings to show examples of a few of the many functionally equivalent techniques and devices for releasably fastening straps to the backpack. The scope of the invention is not limited by the type of fastener 44 used to attach the straps 32 either together or to the pack 30 or to any alternative embodiment according to this disclosure.

Figure 5:
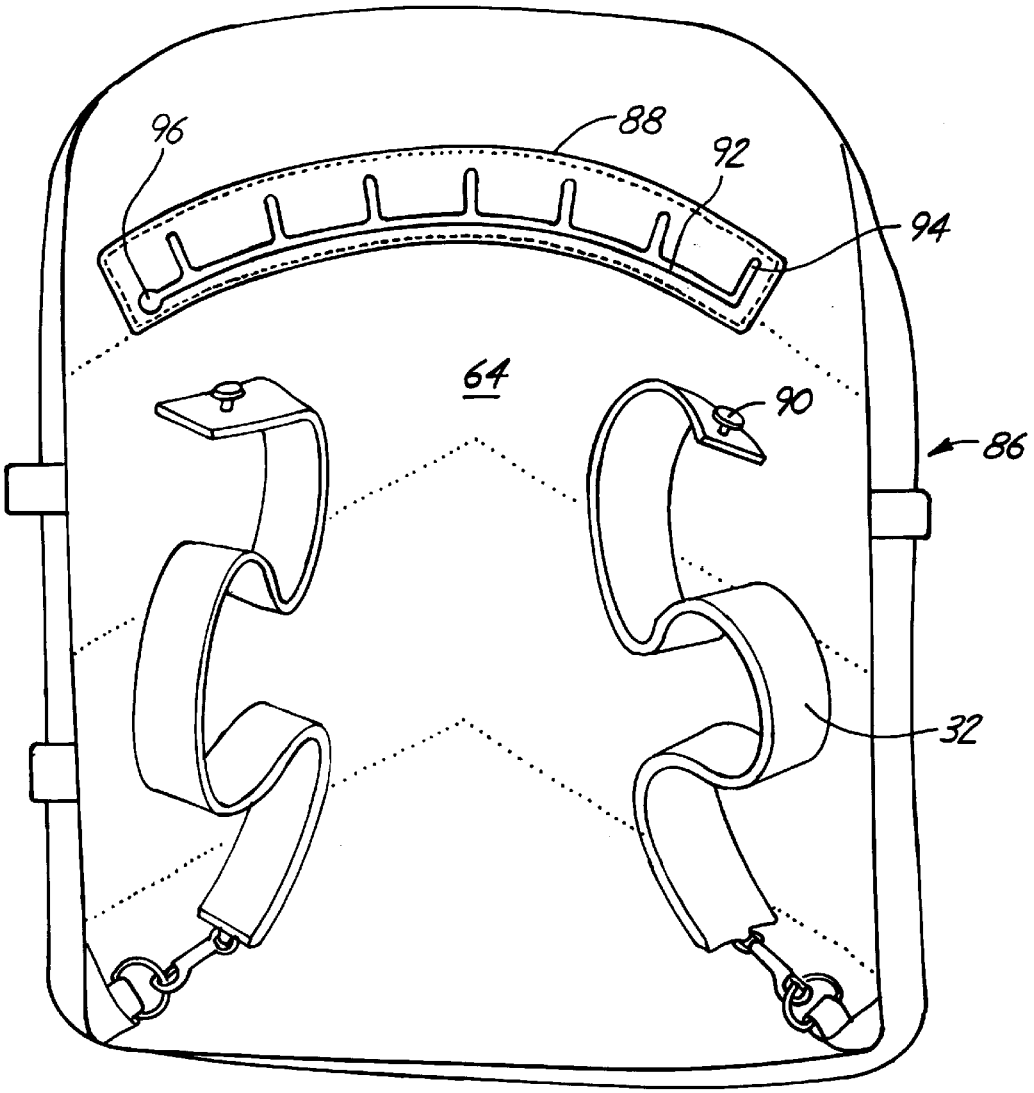
FIG. 5 is a back elevation view of a second alternative embodiment of the backpack having removable re-positionable carrying straps of FIG. 2 wherein the straps are configured for being retained in an adjustable bracket that allows the position of the upper end of the straps to be changed very quickly.

FIG. 5 shows a second alternative backpack embodiment 86 that includes a slotted receiver portion 88 that is affixed to the back 64 of the backpack 30. The receiver 88 is designed to matingly receive a flanged post 90 that is affixed to the second end of each strap 76. The slotted receiver 88 may be made of polymers or metal and affixed by sewing, adhesive, rivets, or other means. The slotted receiver 88 is generally an horizontally elongated planar piece and may be curved to obtain the best fit for the individual who carries the pack 86.

When affixed to a backpack 86 that is being carried in the usual manner, the plane of the receiver 88 is generally vertical. An adjustment slot 92 runs generally parallel to the lower edge of the receiver 88. A series of spaced-apart locking slots 94 extend generally perpendicularly upwardly from the adjustment slot 92. One or more flange pass-throughs 96 are enlargements of the adjustment slot 92 and may be provided as one means for making the straps 32 removable. The pass-through 96 may be made slightly larger than the outside dimension of the flange portion 98 of the releasable flanged post 90 fastener. The adjustment slot 92 and the locking slot 94 width should be slightly greater than the diameter of the post 100.

Figure 5A:
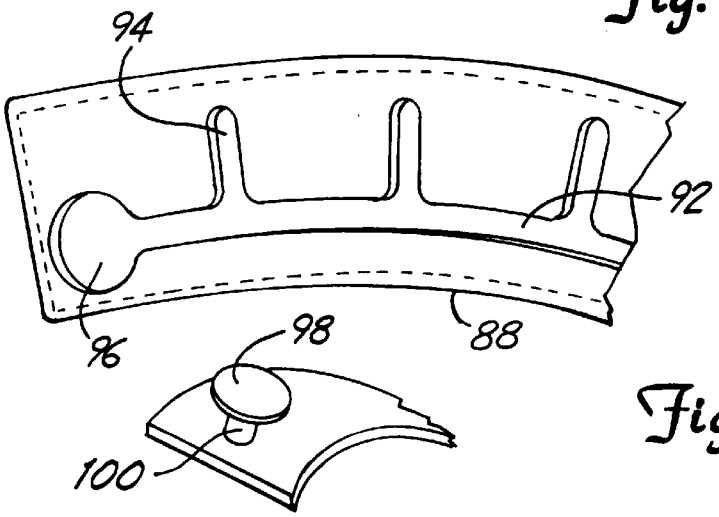
FIG. 5A is a detail of a portion of the strap positioner of the embodiment depicted in FIG. 5.

FIG. 5A shows a portion of the receiver 88 and the flange post 90 in greater detail. Although the receiver 88 is shown as being fabricated from planar material that is relatively thick, it would be equivalent to provide reinforcements that could reduce the thickness and the amount of material used which would yield a corresponding reduction in the weight of the receiver 88. Although the locking slots 94 are shown spaced-apart evenly, it is not necessary to do so. If preferable, the locking slots 94 may be clustered to provide more precise adjustment in the regions where it is beneficial to do so. It would optionally be possible to provide a receiver 88 with an adjustment slot 92 but without locking slots 94. Continuous adjustability would then be possible by replacing the flange post 90 with an axially moveable component that could clamp the adjustment slot between a flange 98 and the substrate to which the post 100 is affixed.

Figure 6:
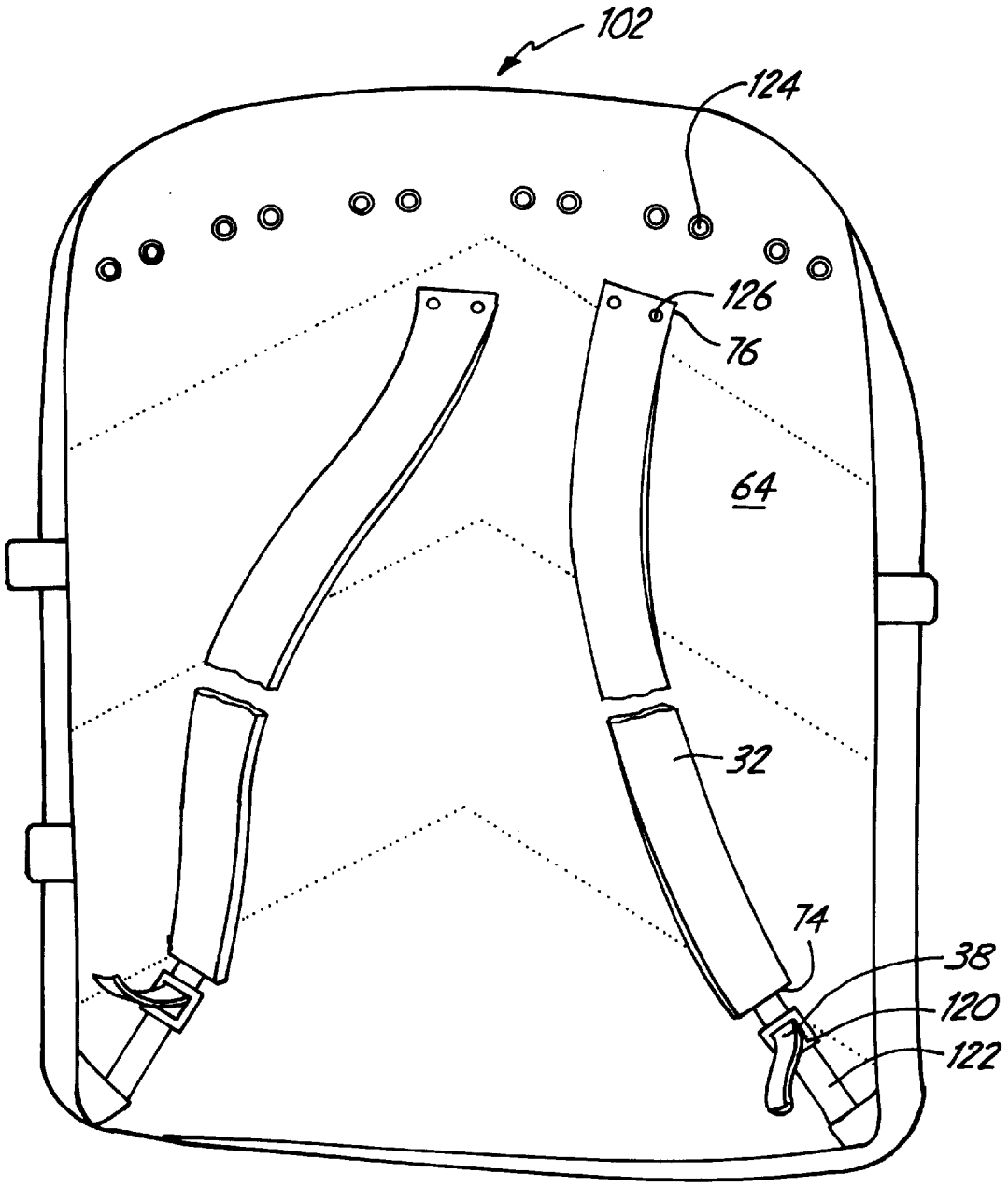
FIG. 6 is a back elevation view of a third alternative embodiment of the backpack having removable re-positionable carrying straps of FIG. 2.

Viewing now FIG. 6, there is depicted a back elevation view of a third alternative embodiment 102 of the backpack having removable re-positionable carrying straps depicted in FIG. 2. The straps 32 of the third alternative embodiment 102 are shown with the first end of the strap 74 fitted with a strap length adjustment 38 portion comprised of a tape, ribbon, web, or belt that fits through a buckle 120. A buckle anchor 122 is securely affixed to the lower portion of the backpack 102 to retain the buckle 120 which may be equipped with a camming latch, a conventional tongue, a sliding lock, or other fastening mechanism.

The third alternative embodiment 102 is shown fitted with snap-type mating portions 124 affixed to the upper part of the back of the article. Corresponding snap-type fastener releasable portions 126 are affixed to the second end of the straps 76. It would also be possible to use snap-type fasteners to attach the first ends of the straps 32 to lower strap attachment points 34. It would be possible to install the snap mating portions with a short length of webbing, belting, or other hinge-like structure between the back of the backpack 64 and the snap mating portion 124. The hinge-like structure could be similar to the buckle anchor 122, except attached nearer the top of the backpack, and would allow the snap mating portion 124 to re-orient as needed to keep the axis of the snap fastener perpendicular to the direction of the load on the strap. Other techniques could also be applied to reduce the potential that a snap connection would accidentally unfasten.

Figure 7:
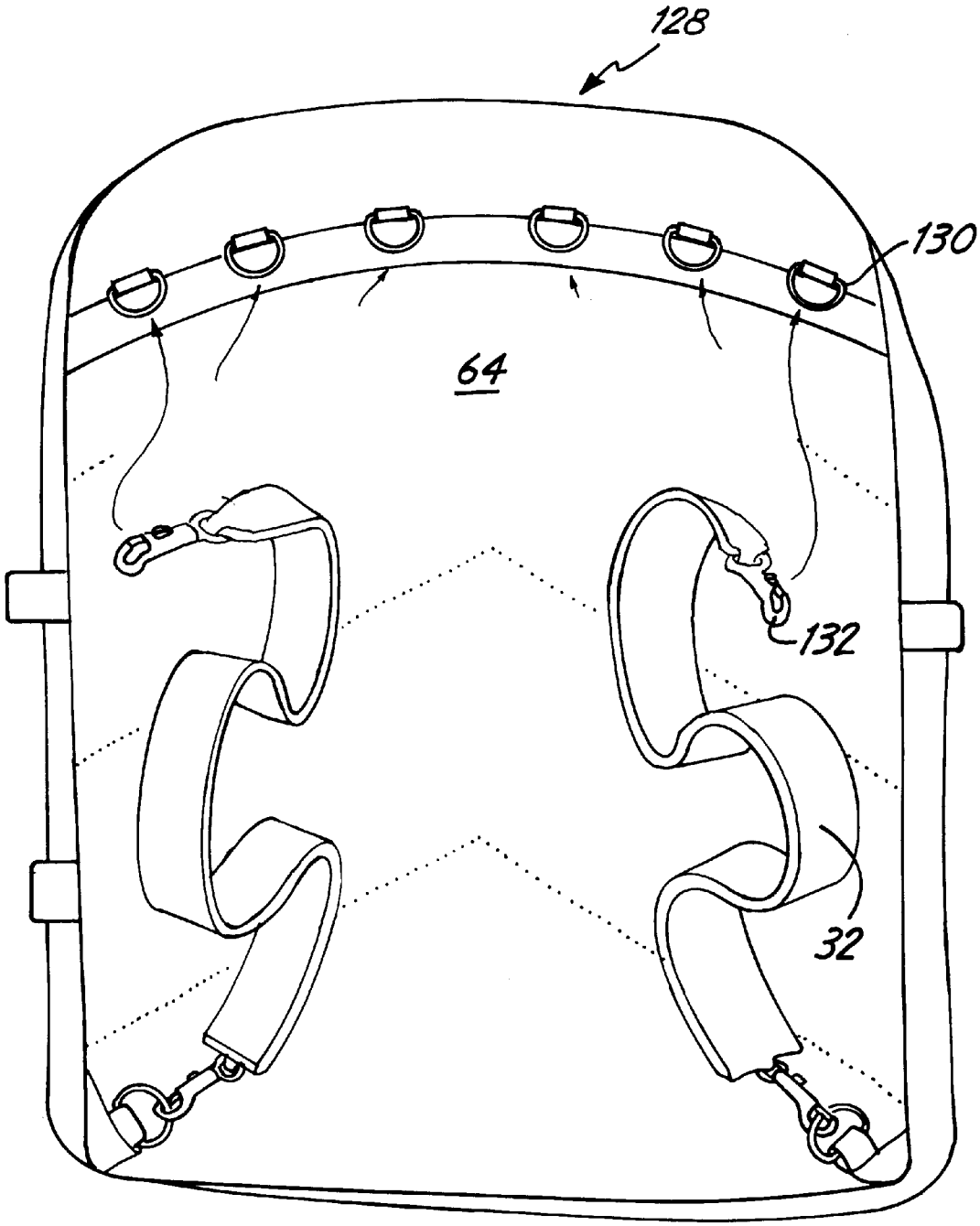
FIG. 7 is a back elevation view of a fourth alternative embodiment of the backpack having removable re-positionable carrying straps of FIG. 2.
Figure 7A:
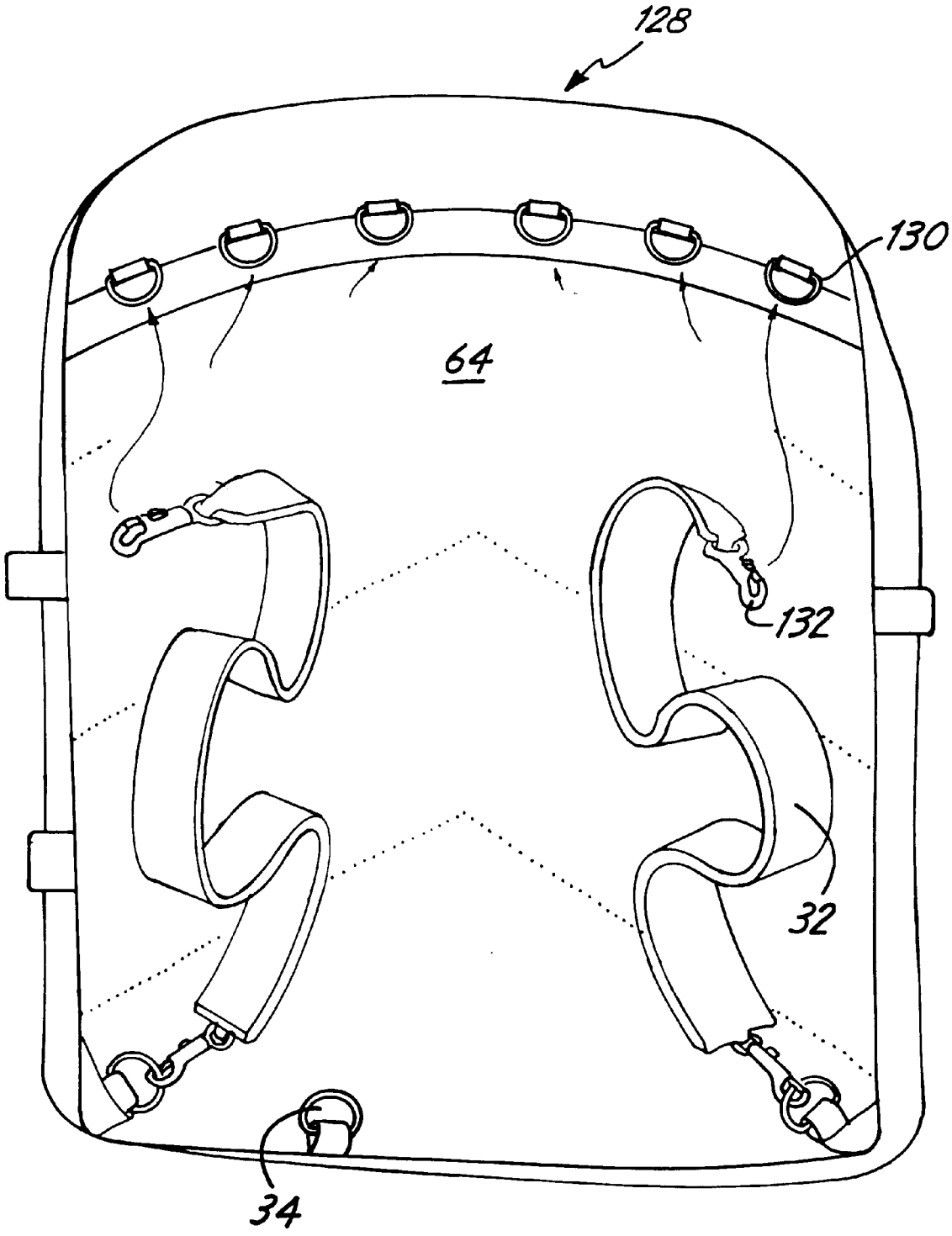

FIG. 7 is a back elevation view of a fourth alternative embodiment 128 of the backpack having removable re-positionable carrying straps of FIG. 2. In a fourth alternative embodiment 128, the upper strap attachment 36 is comprised of a plurality of spaced-apart D-rings 130. The D-rings 130 can be spaced apart vertically either instead of or in addition to the horizontal spacing illustrated. Spring-actuated locking hooks 132 of the type commonly used for soft briefcase straps could be fitted to one or both of the ends of the straps 32 for securing the straps to the D-rings.

It is to be understood that the spring-actuated locking hook is not essential. Easily adjustable removable strap attachments could also be made by mounting a second D-ring 130 in the same webbing loop 42 as each of the D-rings shown in FIG. 7. The spring-actuated locking hook 132 could be replaced with a length of webbing that would easily attach to the paired D-rings 130 by a serpentine path.

Although the lower strap attachment 34 is shown only at the extreme lower left and the extreme lower right corners of the back 64 of the fourth alternative backpack 128 additional lower strap attachments 34 could be installed at any desired location and could be spaced-apart vertically or horizontally from those depicted in any of the drawings.

Figure 8:
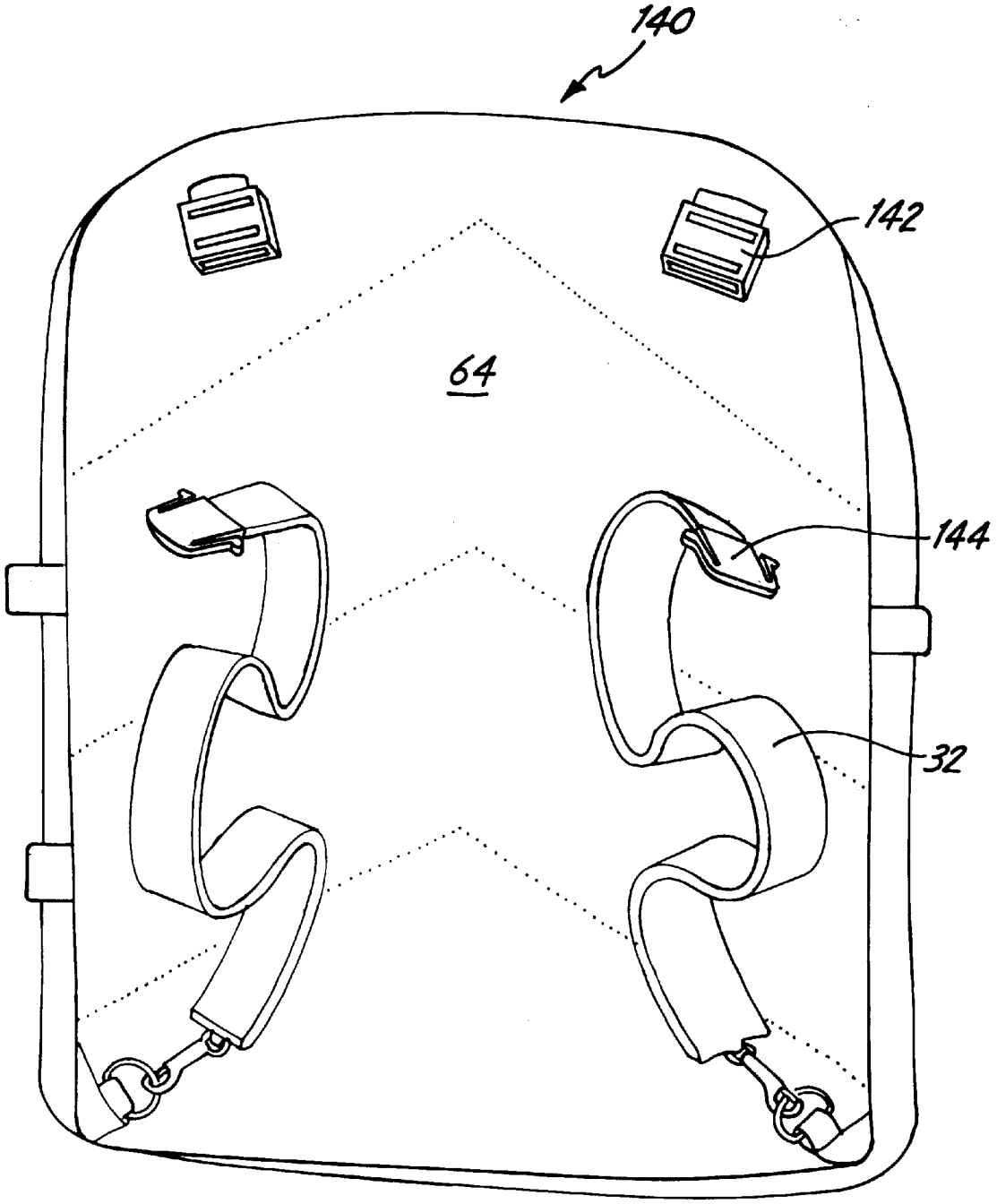
FIG. 8 is a back elevation view of a fifth alternative embodiment of the backpack having removable re-positionable carrying straps of FIG. 2.

In FIG. 8 there is depicted a back elevation view of a fifth alternative embodiment 140 of the backpack. A slide-type in-line fastener mating portion 142 comprises the upper strap attachment 34. An insertable in-line fastener releasable portion 144 is affixed to the second end of the strap 76. Additional in-line mating portions may be provided at other desired locations on the back 64 of the backpack 140.

Figure 9:
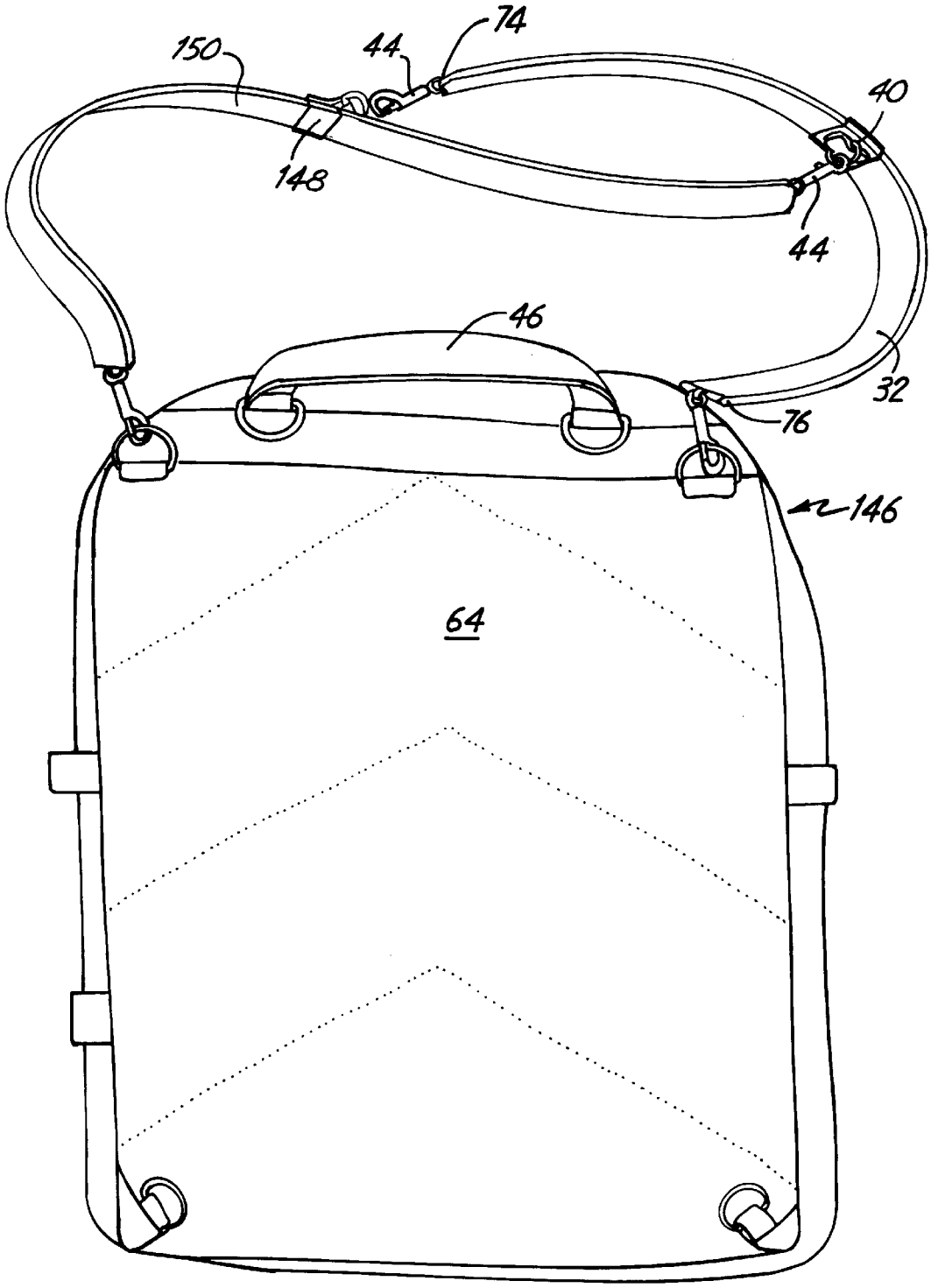
FIG. 9 is a back elevation view of a sixth alternative embodiment of the backpack having removable re-positionable carrying straps of FIG. 2 wherein the straps are configured for being retained in an adjustable bracket that allows the length of a combined strap to be changed quickly.

FIG. 9 is a back elevation view of a sixth alternative embodiment 146 of the backpack having removable re-positionable carrying straps of FIG. 2. The sixth alternative embodiment 146 is like first alternative embodiment 78 depicted in FIG. 4 except for differences in the construction of the straps 32. The first end 74 of each strap 32 may be released from the lower strap attachment 34 and then connected together in an overlapping configuration so that the backpack 146 may also be carried at a person's side as a shoulder bag from either shoulder or across the torso.

Each of the backpack straps 32 may be provided with any of various types of commercially available, adjustable, strap-engaging brackets 148 to allow the length of the combined strap to be adjusted. By way of example, the brackets 148 may be of the type commonly used in belt buckles for webbing belts of the type often worn with military uniforms and other apparel. The brackets 148 may be equipped with mating fastener portions 40 corresponding to the releasable fastener portions 44 fitted to the first ends of the straps 74. The length of the combined strap 150 may be changed quickly and easily by relocating the brackets 148 along the straps 32. The embodiment may also be fitted with mating fastener portions on the sides as illustrated in FIG. 4 (reference numbers 66, 68, 83, and 84).

Changes and modifications in the specifically described embodiments can be carried out without departing from the scope of the invention which is intended to be limited only by the scope of the appended claims.

| ELEMENTS WITH DRAWING REFERENCE NUMBERS | |
|---|---|
| 20 | prior art backpack |
| 22 | prior art straps |
| 24 | prior art lower attachment |
| 26 | prior art upper attachment |
| 28 | strap length adjustment |
| 30 | backpack having removable, re-positionable carrying straps |
| 31 | person carrying backpack |
| 32 | removable straps |
| 34 | lower strap attachment point |
| 36 | upper strap attachment |
| 38 | strap length adjustment |
| 40 | mating fastener portion |
| 42 | webbing loop |
| 44 | releasable fastener portion |
| 46 | handle |
| 60 | sack |
| 62 | front |
| 64 | back |
| 66 | first side |
| 68 | second side |
| 70 | bottom |
| 72 | top |
| 74 | first end of strap |
| 76 | second end of strap |
| 78 | first alternative embodiment |
| 80 | pad |
| 81 | hook portion |
| 82 | loop portion |
| 83 | first side mount mating portion |
| 84 | second side mount mating portion |
| 86 | second alternative embodiment |
| 88 | receiver |
| 90 | flanged post |
| 92 | adjustment slot |
| 94 | locking slot |
| 96 | flange pass-through |
| 98 | flange |
| 100 | post |
| 102 | third alternative embodiment |
| 120 | buckle |
| 122 | buckle anchor |
| 124 | snap mating portion |
| 126 | snap releasable portion |
| 128 | fourth alternative embodiment |
| 130 | D-ring |
| 132 | spring-action locking hook |
| 140 | fifth alternative embodiment |
| 142 | in-line fastener mating portion |
| 144 | in-line fastener releasable portion |
| 146 | sixth alternative embodiment |
| 148 | bracket |
| 150 | combined strap |

What is claimed is:

1. A backpack having removable, re-positionable carrying straps comprising:

a. a sack having a front portion, a back portion, a first side portion, a second side portion, a bottom, and a selectably closeable and openable top, b. at least two carrying straps, each carrying strap having a first end and a second end, c. a releasable fastener portion affixed proximate the first end of each of the carrying straps, d. a releasable fastener portion affixed proximate the second end of each of the carrying straps, e. a plurality of mating fastener portions affixed to the back of the sack and arranged with at least three transversely spaced apart mating fastener portions proximate the bottom of the sack and at least three mating fastener portions being affixed to the sack proximate the top, f. at least one top mating fastener portion being disposed transversely between the center of the sack back portion and the first side portion, g. at least one top mating fastener portion being disposed transversely between the center of the sack back portion and the second side portion, and h. each mating fastener portion being adapted to selectably engage a releasable fastener portion.

2. The backpack described in claim 1, wherein the transversely spaced apart mating fastener portions proximate the top of the sack are comprised of a slotted receiver and the releasable fastener portions are comprised of flanged posts.

3. The backpack described in claim 2 being further comprised of a closure portion that can cover the opening at the top of the sack.

4. A backpack having removable, re-positionable carrying straps comprising:

a. a sack having a front portion, a back portion, a first side portion, a second side portion, a bottom, and a selectably closeable and openable top, b. at least two carrying straps, each of which has a first end terminated by a first releasable fastener portion and a second end terminated by a second releasable fastener portion, c. at least two transversely spaced-apart first mating fastener portions affixed proximate the bottom of the sack, each of the first mating fastener portions being adapted to selectably engage a first releasable fastener portion, and d. at least one second mating fastener portion affixed generally laterally centrally proximate the top of the sack, and at least one additional second mating fastener portion spaced-apart laterally from each side of the centrally positioned second mating fastener portion, each of the second mating fastener portions being adapted to selectably engage a second releasable fastener portion.

5. The backpack described in claim 4 being further comprised of a means for connecting the first ends of two straps together to make a single longer strap.

6. The backpack described in claim 4 being further comprised of means for adjusting the lengths of the straps.

7. The backpack described in claim 4 being further comprised of a closure portion that can cover the opening at the top of the sack.

8. The backpack described in claim 7 being further comprised of means for adjusting the lengths of the straps.

9. The backpack described in claim 7 wherein there is a mating fastener portion affixed to the first side portion and a mating fastener portion affixed to the second side portion.

10. The backpack described in claim 9 being further comprised of means for adjusting the lengths of the straps.

11. The backpack defined in claim 10 wherein the carrying straps are further comprised of an indicia-bearing surface, from which surface advertisements can be displayed that show at least one item from the group comprised of affiliation, endorsement, and articles of commerce.

* * * * *